US006041792A

United States Patent [19]

Kennedy

[11] Patent Number: 6,041,792

[45] Date of Patent: Mar. 28, 2000

[54] HAIR ORNAMENT AND METHOD OF ORNAMENTING HAIR

[75] Inventor: Kathy Kennedy, Rancho Santa Margarita, Calif.

[73] Assignee: Beadwear. Inc., Rancho Santa Margarita, Calif.

[21] Appl. No.: 09/314,876

[22] Filed: May 19, 1999

[51] Int. Cl.[7] ..... A45D 8/12

[52] U.S. Cl. ..... 132/275; 132/273; 132/200

[58] Field of Search ..... 132/273, 274, 132/200, 212, 201, 276, 275, 278; 446/48, 487; 273/155; 59/78, 80, 83, 84; 63/4; D11/17, 15; D28/39, 40, 41

[56] References Cited

U.S. PATENT DOCUMENTS

| | | | |
|---|---|---|---|
| D. 220,019 | 2/1971 | Solomon | 132/273 |
| D. 317,663 | 6/1991 | Calderon . | |
| D. 348,331 | 6/1994 | Marrese | 132/273 |
| D. 353,226 | 12/1994 | Nahoum . | |
| 1,144,504 | 6/1915 | Schneider . | |
| 2,567,408 | 9/1951 | Soderberg . | |
| 2,943,371 | 7/1960 | Patterson . | |
| 3,045,684 | 7/1962 | Stolz . | |
| 3,301,266 | 1/1967 | Hoffmann | 132/273 |
| 3,751,769 | 8/1973 | Reiner | 132/273 |
| 3,842,849 | 10/1974 | Goodman . | |
| 4,315,362 | 2/1982 | Pigford et al. . | |
| 4,411,050 | 10/1983 | Couture | 63/4 |
| 4,779,616 | 10/1988 | Johnson . | |
| 5,097,854 | 3/1992 | Smith . | |
| 5,154,196 | 10/1992 | Moffat . | |
| 5,167,245 | 12/1992 | Harriett | 132/273 |
| 5,289,834 | 3/1994 | Lawrence | 132/212 |
| 5,365,954 | 11/1994 | Rude . | |
| 5,388,598 | 2/1995 | Whitten . | |
| 5,417,230 | 5/1995 | Wood . | |
| 5,454,385 | 10/1995 | George . | |
| 5,456,271 | 10/1995 | Legette . | |
| 5,497,795 | 3/1996 | Hibbard | 132/275 |
| 5,555,901 | 9/1996 | Camp, Jr. et al. | 132/273 |
| 5,558,105 | 9/1996 | Rosenwinkel et al. . | |
| 5,562,688 | 10/1996 | Riza . | |
| 5,566,690 | 10/1996 | Shih-Ming . | |
| 5,573,017 | 11/1996 | Post . | |
| 5,664,707 | 9/1997 | Spector . | |
| 5,669,399 | 9/1997 | Camp, Jr. et al. | 132/273 |
| 5,687,751 | 11/1997 | Villani . | |
| 5,713,218 | 2/1998 | McCabe . | |
| 5,797,408 | 8/1998 | Wilson . | |
| 5,810,022 | 9/1998 | Reynolds . | |
| 5,833,335 | 11/1998 | Voughlohn . | |
| 5,881,738 | 3/1999 | Villani . | |

*Primary Examiner*—Jeffrey A. Smith
*Assistant Examiner*—Pedro Philogene
*Attorney, Agent, or Firm*—Weide & Associates

[57] ABSTRACT

An ornament for ornamenting a stringing material such as hair, and method of ornamenting such stringing material is disclosed. An ornament in accordance with an embodiment of the invention comprises a retention element for affixing the ornament to stringing material, and at least one loop element associated with the retention element. Each loop element has a circumference and an interior portion through which stringing material may pass. The circumference of each loop element has a generally fixed total length. In one or more embodiments, there are two loop elements arranged in sequence generally along a first axis. The at least two of the loop elements are movably connected to one another about at least a second axis extending generally perpendicular to the first axis. In one or more embodiments the loop elements are defined by a filament material such as ribbon or wire or comprise rings or tubular elements.

20 Claims, 4 Drawing Sheets

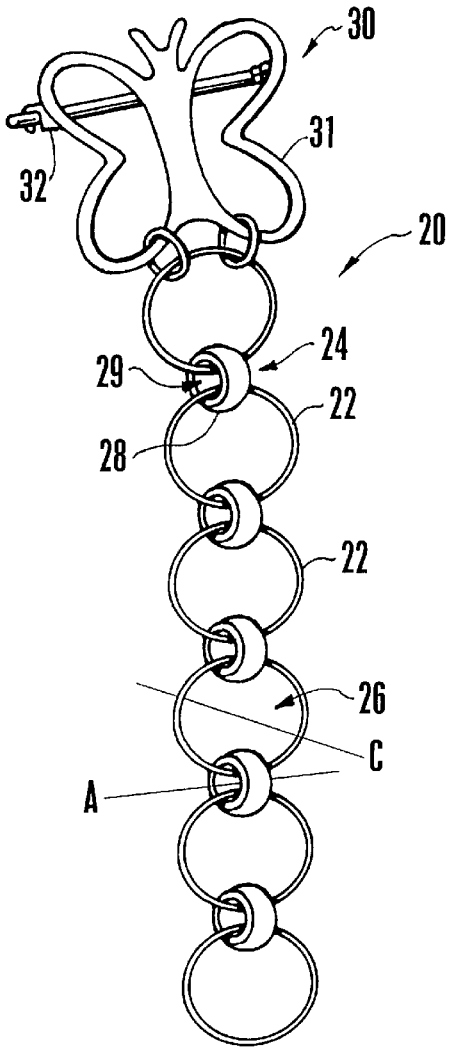
Fig. 1
Fig. 2
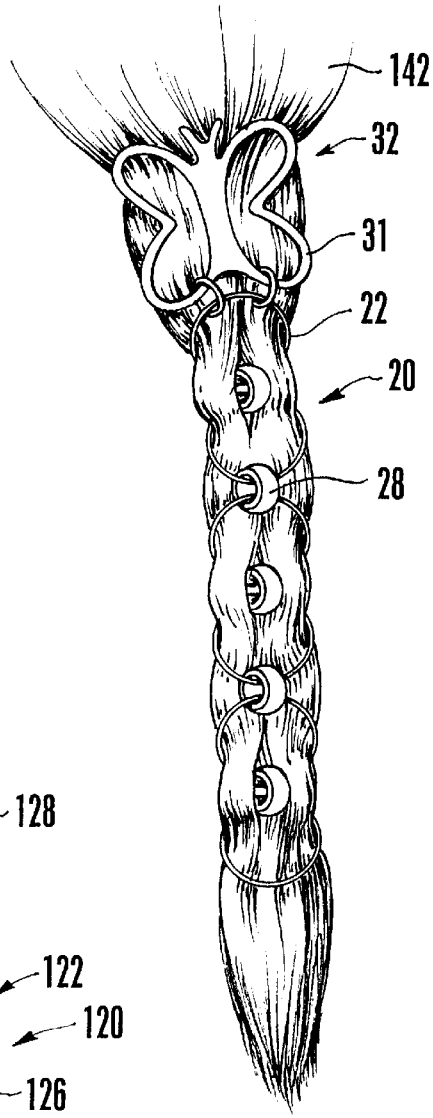
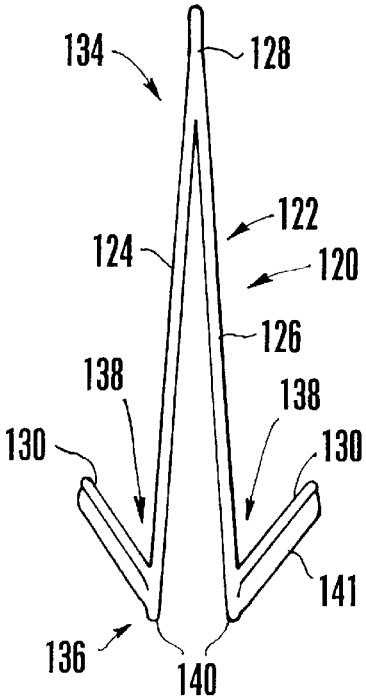
Fig. 3

Fig. 10
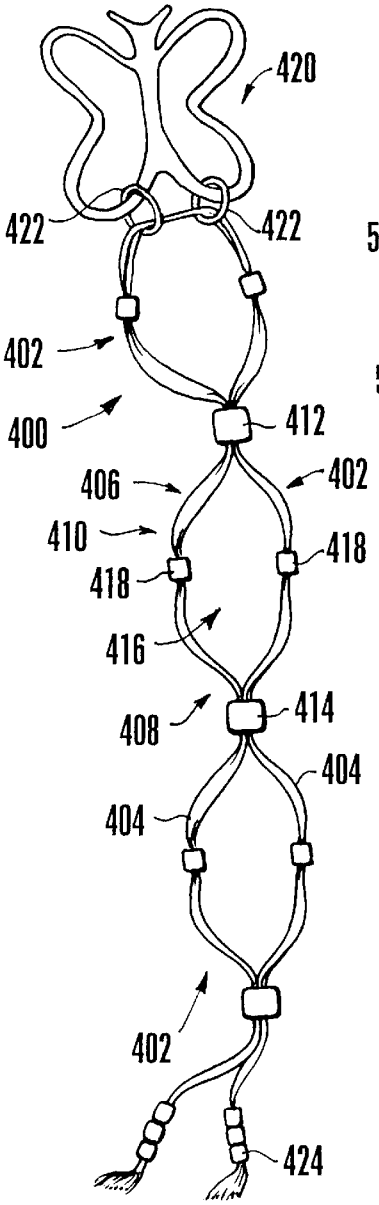
Fig. 11
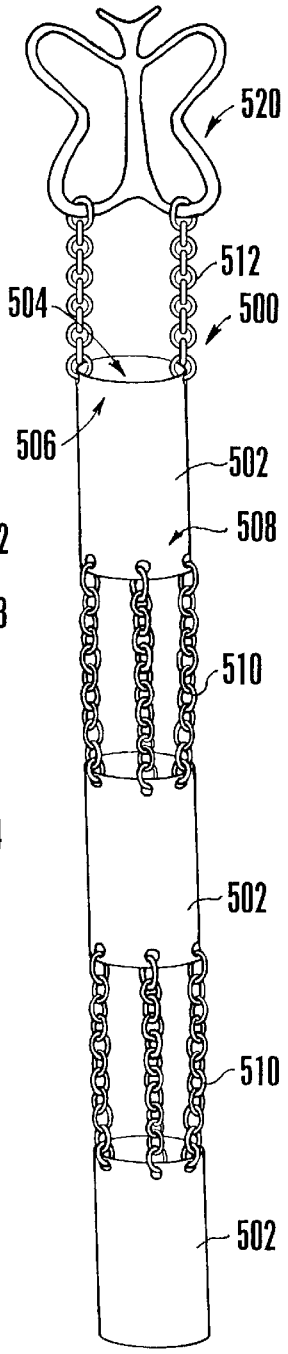
Fig. 12
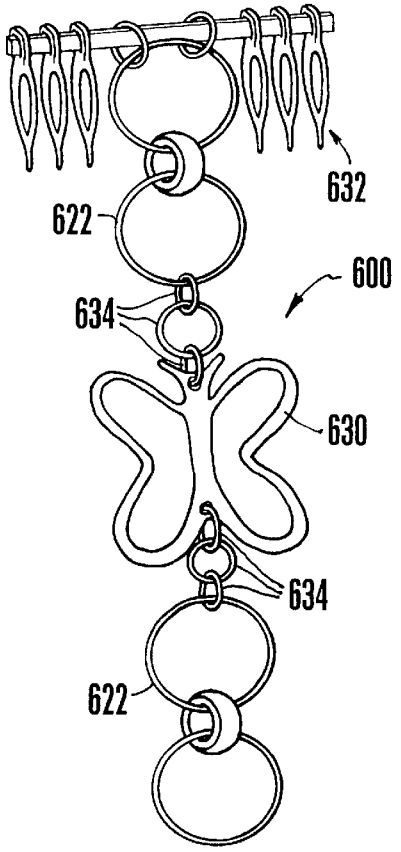
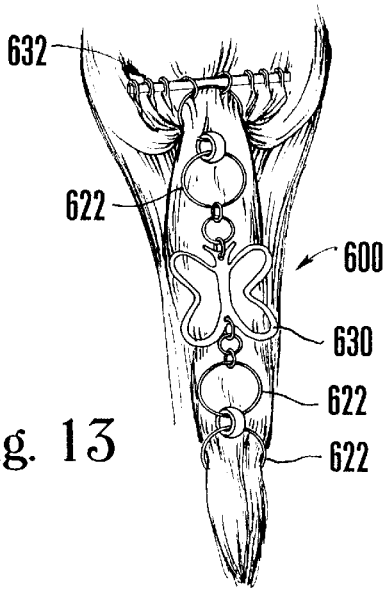
Fig. 13

HAIR ORNAMENT AND METHOD OF ORNAMENTING HAIR

FIELD OF THE INVENTION

This invention relates to ornaments of the type placed in or on hair or other ornament stringing material, and methods of ornamenting hair.

BACKGROUND OF THE INVENTION

A variety of ornaments are known for use with hair. These ornaments are placed in hair for both functional and aesthetic reasons. Some hair ornaments, such as "banana clips," barrettes, and pins, serve the function of retaining hair in a particular position or arrangement.

Other ornaments, such as hair beads, flowers, and ornamented clips are placed in the hair primarily for their visual effect. These items may be visually appealing themselves, and may also make the hair more visually appealing. Of course, some hair ornaments serve both functional and aesthetic purposes, such as colored barrettes, pony-tail bows and the like.

A common problem associated with many ornaments is that they are difficult to place and retain in or on the hair. For example, U.S. Pat. Nos. 5,555,901 and 5,669,399 to Camp, Jr. et al. disclose hair forming devices comprising a series of fixed rings. The rings are fixed in generally the same plane, with adjacent rings forming a "figure-8." As one aspect of this arrangement, the devices are rigid and cumbersome and does not in any way conform to the flexible nature of hair or the curvature of the head. Further, as illustrated therein, at least two braids of hair must be formed and passed separately through the series of rings. As is well known, the manual braiding of hair can be quite difficult and frustrating. However, in this rigid arrangement of the device no more convenient means is apparent for placing the device on the hair.

A number of hair ornaments comprising resilient members are known. As one example, a rubber band may be used to form a pony tail from hair. U.S. Pat. No. 5,497,795 to Hibbard and U.S. Des. Pat. No. 348,331 to Marrese disclose a hair braiding apparatus and hairband, respectively. The Hibbard reference discloses a method for french braiding hair using a braiding aid comprising a number of resilient loops. In accordance with the method, two strands of hair are crossed and passed through loops of the braiding aid while the user expands the loop with a thumb and forefinger. Again, this method is difficult because the placement of the hair through each loop is entirely manual. In addition, because the loops of the braiding aid are resilient, the loops must be expanded during braiding of the hair. This is difficult because one must at the same time expand the loop in order to make it large enough to place the hair through, and grasp and feed the hair through the enlarged loop. Because these apparatus must be constructed of a material which is elastic, the apparatus also has limited ornamental value.

The Marrese device appears similarly arranged to the Hibbard device, with a number of apparently resilient loops connected to one another. As illustrated therein, hair may be passed through all of the loops to form a ponytail. This device has the same problems and drawbacks as the Hibbard device, apparently differing only in the visual appearance of having a "gathered" fabric exterior.

A hair ornament which is both aesthetically pleasing and which is easy to place on hair is desired.

SUMMARY OF THE INVENTION

One or more embodiments of the invention comprise an ornament for ornamenting a stringing material, such as hair.

One more other embodiments of the invention comprise a method for ornamenting stringing material such as hair.

In accordance with one or more embodiments of the invention, the ornament comprises a retention element for affixing the ornament to stringing material and at least one loop element associated with the retention element. Each loop element has a circumference and an interior portion through which stringing material may pass. The circumference of each loop element has a generally fixed total length.

Where the ornament includes multiple loop elements, the loop elements are generally arranged sequentially along a first axis. In addition, the loop elements are movably connected to one another about at least a second axis extending generally perpendicular to the first axis.

In accordance with one embodiment of the invention, the retention element comprises an ornamental clasp, barrette, clip or the like. In accordance with another embodiment, the retention element comprises a comb.

In one or more embodiments a loop element is defined by a filament material such as ribbon, chain, links, or wire. In other embodiments, a loop element comprises a ring or a tubular element.

In accordance with an embodiment of the method, an ornament is placed on ornament stringing material such as hair with a tool. One or more of the loop elements are threaded over a portion of the tool. Ornament stringing material is extended through a portion of the tool, and then the one or more loop elements are moved off of the tool, over and onto the ornament stringing material. The retention element is connected to or affixed to the ornament stringing material to retain the ornament thereon.

Further objects, features, and advantages of the invention over the prior art will become apparent from the detailed description of the drawings which follows, when considered with the attached figures.

DESCRIPTION OF THE DRAWINGS

FIG. 1 is a perspective view of an ornament in accordance with a first embodiment of the present invention;

FIG. 2 illustrates the ornament illustrated in FIG. 1 placed onto hair of a wearer;

FIG. 3 illustrates an apparatus for placing an ornament of the present invention on ornament stringing material such as hair;

FIG. 10 is a perspective view of an ornament in accordance with a fourth embodiment of the present invention;

FIG. 11 is a perspective view of an ornament in accordance with a fifth embodiment of the present invention;

FIG. 12 is a perspective view of an ornament in accordance with a sixth embodiment of the present invention; and FIG. 13 illustrates the ornament illustrated in FIG. 12 positioned on the hair of a wearer.

DETAILED DESCRIPTION OF THE INVENTION

Figure 4:
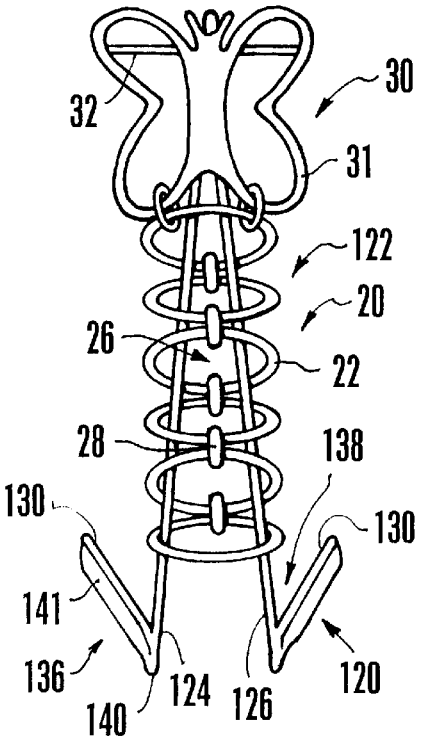
FIG. 4 illustrates the apparatus illustrated in FIG. 3 with the ornament illustrated in FIG. 1 placed thereon.

The invention is a hair ornament and method of ornamenting hair. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

One or more embodiments of the invention comprise an ornament for positioning in or on an ornament stringing material such as hair. Several embodiments of ornaments are described below. In general, each ornament comprises a retention element and at least one element associated therewith adapted to permit the passage of ornament stringing material therethrough.

As used herein, the term ornament stringing material is intended to mean any of a variety of materials on which an ornament of the invention may be placed. For example, the ornament stringing material may comprise string, yarn, synthetic hair or the like. In a preferred embodiment, the stringing material comprises hair, such as the artificial hair of a doll or the hair of a human. While the ornaments described below may be placed or positioned on a wide variety of such materials, the ornaments are referred to as hair ornaments because of their preferred application.

FIG. 1 illustrates a hair ornament 20 in accordance with one embodiment of the invention. The ornament 20 comprises a retention element and one or more loop elements. In accordance with the embodiment illustrated, the one or more loop elements comprise rings 22. Each ring 22 comprises a relatively rigid closed loop of material. In one or more embodiments, each ring 22 comprises a generally circular metal loop.

The rings 22 may have a variety of shapes other than circular. For example, the rings 22 may be ovoid, elliptical, square, rectangular, triangular and even irregular. In addition, the rings 22 may be constructed from a wide variety of materials, such as metal, plastic and wood.

Regardless of the shape or material comprising the ring 22, each ring 22 defines a passage 26 through which one or more hair strands may pass. An axis or centerline C extends through this passage 26. In the arrangement of the rings 22 illustrated, the rings 22 are generally planar and the axis C extends generally perpendicular to the plane in which the ring lies.

Advantageously, at least one pair of rings 22 of the hair ornament 20 are movably connected to one another. In a preferred embodiment, the rings 22 are connected so that each pair of rings may move about an axis A. As illustrated in FIG. 1, the axis A extends generally perpendicular to the axis C extending through the passage 26 of the ring 22.

In one or more embodiments, the ornament 20 includes multiple rings 22 connected to one another. The exact number of rings 22 may vary. In addition, the exact size of the rings 22 may vary. In one or more embodiments, each ring 22 is approximately 0.5 inches in diameter.

In the preferred embodiment, the rings 22 are arranged sequentially. In a more preferred arrangement, the rings 22 are arranged in a line or row along a generally common axis.

In one or more embodiments, at least one pair of rings 22 are movably connected to one another are connected by a swivel element 24. As illustrated, the swivel element 24 comprises a connector 28 through which two rings 22 pass. The connector 28 defines a passage 29 through which the axis A extends. Each ring 22 extends through this passage 29.

The connector 28 may be constructed of a wide variety of materials, such as metal, plastic or wood. Of course, the connector 28 may have a wide variety of shapes, sizes, colors and the like, so long as it serves the above-described purpose.

A wide variety of other means are contemplated for connecting at least one pair of rings 22 in a manner which permits their movement as described above. For example, rings 22 may be connected to opposing portions of a hinge element. Likewise, rings 22 may be provided with an outwardly extending mount and be connected to one another ring with a pin which extends through the pairs of mounts of adjacent rings 22 (the pin extending along the axis A).

In one or more embodiments, the hair ornament 20 includes means for securing the ornament 20 to hair. As illustrated, this means comprises a hair retention element in the form of a barrette-type hair lock 30.

The lock 30 as illustrated comprises a butterfly shaped ornament having a body 31 and a clasp 32. The clasp 32 is moveable between an open unlocked position and a closed locked position. In the open position, one or more strands of ornament stringing material may be positioned between the clasp 32 and the body 31 of the lock 30. When in the closed position, the ornament stringing material is compressed between the clasp 32 and the body 31 of the lock 30, retaining the lock 30 securely on the ornament stringing material.

As described in more detail below, a wide variety of retention elements may be used. When the retention element comprises a lock 30, the lock 30 may have a variety of configurations and appearances.

Preferably, the lock 30 or other retention element is positioned at one end of the ornament 20. As illustrated, the lock 30 is connected to an end-most one of the rings 22. In the embodiment illustrated, the lock 30 is moveably connected to the ring 22 by a pair of smaller rings or loops. The lock 30 may instead be rigidly connected to one of the rings 22.

One or more embodiments of the invention comprise a method of ornamenting ornament stringing material such as hair with at least one hair ornament 20 to produce an effect such as that illustrated in FIG. 2. One method of the invention comprises placing the hair ornament 20 on hair with a tool 120 such as illustrated in FIGS. 2–7.

The tool 120 comprises a generally inverted "V"-shaped body 122. The tool 120, including the body 122, has a proximal end 134 and a distal end 136. The body 122 has a first link or leg 124 and a second link or leg 126. The first and second legs 124,126 each have a first or proximal end. The first ends of the legs 124,126 are connected or joined at the proximal end 134 of the body 122. The first and second legs 124,126 also each have a second or distal end.

The tool 120 includes a stop element associated with each leg 124,126. As described in more detail below, a stop is formed at the distal end of each foot 124,126 by a foot 130 cooperating with each leg 124,126.

The proximal end 134 of the tool 120 is configured so that it will fit through or within one or more of a variety of ornaments, such as passage 26 through the rings 22 of the ornament 20 described above. A tip 128 is defined at the proximal end 134 of the body 122. The tip 128 extends from the connection of the first ends of the legs 124,126 in a direction opposite the distal end 136 of the body 122. The tip 128 preferably has the shape of a needle-tip, shaft or pointed threader.

Figure 5:
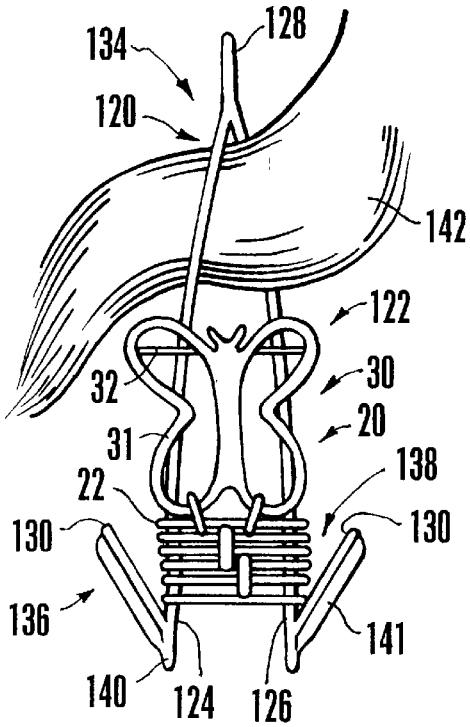
FIG. 5 illustrates the apparatus illustrated in FIG. 4 with ornament stringing material extended through a portion of the apparatus.
Figure 6:
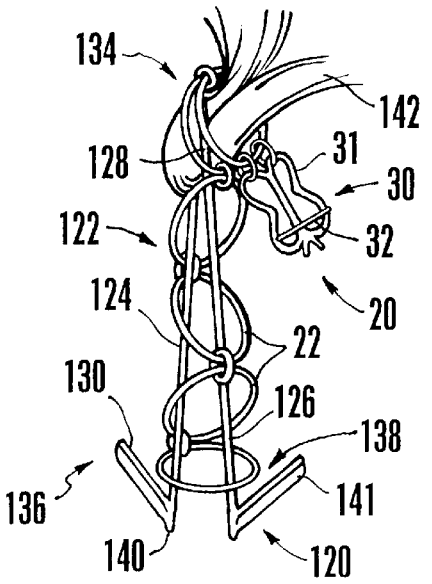
FIG. 6 illustrates the apparatus illustrated in FIG. 5 as the ornament on the apparatus is moved onto the hair.

The legs 124,126 are arranged to move with respect to one another between positions in which they are closer and farther apart, as illustrated in FIGS. 4 and 5. As such, in one or more embodiments, at least a portion of the body 122 of the tool 120 comprises a somewhat flexible material. In addition, means are provided for biasing the legs 124,126 apart from one another, whereby the tool naturally assumes a position such as that illustrated in FIG. 2. This biasing means may comprise the natural resiliency of the material of which the tool 120 is constructed.

The distal end 136 of the tool 120 is configured to prevent an ornament which has been placed on the tool 120 (as described in more detail below) from becoming disassociated from the tool 120. In this regard, in one or more embodiments, two stops are provided at the distal end 136 of the tool 120. Each stop comprises a trough 138 formed between a foot 130 and its respective leg 124,126. As illustrated, one foot 130 extends outward from the second end of the first leg 124 and another foot extends outward from the second end of the second leg 126. Preferably, each foot 130 diverges or extends away from its adjacent leg 124,126 moving in the direction of the distal to the proximal end 138,136 of the body 122 of the tool 120.

As illustrated, each foot 130 cooperates with its adjacent leg 124,126 to form a trough 138 which is generally "V"-shaped. Preferably, similar to the tip 128 at the proximal end of the tool 120, a tip 140 is provided at the interconnection of each foot 130 and its mating leg 124,126. These distal tips 140 are positioned opposite the troughs 138 and extend in a direction generally opposite the proximal end 134 of the body 122 of the tool 120. These tips 140 (similar to tip 128) aid in maintaining each foot 130 apart from its adjacent leg 124,126, keeping the troughs 138 in an open position.

The body 122 of the tool 120 may have a variety of constructions, shapes and sizes, dependent upon the application.

One method of using the tool 120 to place one or more ornaments 20 on ornament stringing material is as follows. First, referring to FIG. 4, the ornament 20 is placed on the tool 120. This may be accomplished by threading the tool 120 through one or more of the rings 22 of the ornament 20, such as by extending the tip 128 (obscured in the view of FIG. 4) through the aperture 26 of each ring 22 of the ornament 20. In the arrangement illustrated, the tip 128 of the tool 120 is passed through each of the rings 22 of the ornament 20 through which the stringing material is to pass. In the embodiment illustrated, all the rings 22 are threaded onto the tool 20 which will result in the stringing material passing through all of the rings 22. As described in greater detail below, it is not necessary for every ring 22 or loop element of the ornament 20 to be placed on the tool 120.

As illustrated, placement of the ornament 20 onto the tool 120 is facilitated because the rings 22 of the ornament 20 are moveably connected. During placement of the ornament 20 onto the tool 120, the rings 22 are permitted to move into a position where a common axis extends through the apertures 26 defined by the rings 22. The tool 120 is moved along this axis to thread the ornament 20 onto the tool 120. In addition, the movement of the rings 22 allows them to collapse or fold onto one another so that they lie in generally parallel planes. The reduces the size of the ornament 20 so that it fits onto the tool 120, as illustrated in FIG. 4.

The ornament 20 is moved distally along the body 122 of the tool 120 over the legs 124,126. The ornament 20 is moved along the body 122 of the tool 120 until it is completely placed onto the tool 120. The ornament 20 is prevented from being removed from the distal end 136 of the tool, such as by falling, by the foot 130 which extends from each leg 124,126.

Next, referring to FIG. 5, ornament stringing material 142 is threaded or directed between the legs 124,126 at a location along the tool 120 between the proximal end 134 of the tool 120 and the top-most ring 22 of the ornament 20 which is placed onto the tool.

Referring to FIG. 5, in a next step the ornament 20 is moved upwardly towards the proximal end 134 of the tool 120. Ultimately all of the rings 22 of the ornament 20 are moved off of the proximal end 134 of the tool 120 and onto the ornament stringing material 142. In this step, the free end of the ornament stringing material 142 may loop back upon itself. This is especially true if the size of the passage through the ornament 20 is small in relation to the thickness of the ornament stringing material 142. In the embodiment illustrated in FIG. 6, the ornament stringing material 142 is illustrated as looping back upon itself. Once the ornament 20 is moved further upwardly along the stringing material 142, the ornament 20 is moved past the free end of the material.

In the above-described method, the movement of the ornament 20 and tool 120 are relative. Thus, the ornament 20 may be moved with respect to the tool 120, the tool 120 with respect to the ornament 120, or both moved at the same time.

Figure 7:
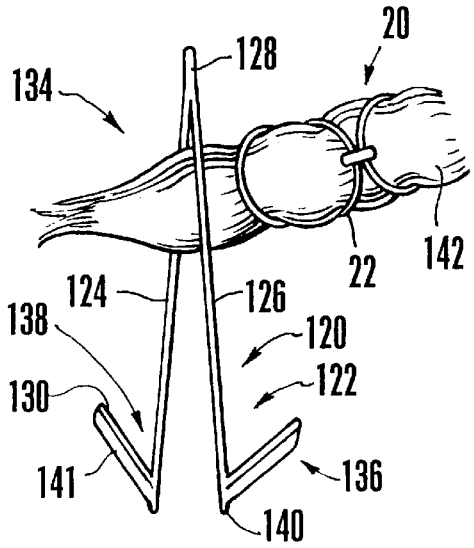
FIG. 7 illustrates the apparatus illustrated in FIG. 6 with the ornament placed on the hair and being removed from the apparatus.

As illustrated in FIG. 7, once the ornament 20 is placed on the ornament stringing material 142, the ornament stringing material 142 and tool 120 may be separated. If the ornament stringing material 142 looped back on itself when the ornament 20 is placed thereon, then the free end of the material 142 may be pulled back through the ornament 20.

When the ornament 20 is placed onto the stringing material 142, the stringing material 142 alternately passes over and under the connections between the pairs of rings 22, as best illustrated in FIG. 2. This is due to the position of the rings 22 as they are placed on the tool 120 (the loop elements 28 are positioned on alternating sides of the tool 120 when the ornament 20 is placed thereon, as illustrated in FIG. 4).

Once the ornament 20 is moved off of the tool 120 and positioned on the stringing material 142, the lock 30 is engaged with the stringing material to affix the ornament 20 to the stringing material. Where the lock 30 is as described above, this step comprises opening the clasp 32, placing some stringing material between the clasp 32 and the body portion 31 of the lock 30, and then reclosing the clasp 32.

Those of skill in the art will also appreciate that the hair ornament 20 may be placed on the stringing material 142 in a manner other than with the tool 120 as described above. For example, the hair ornament 20 may also be placed on hair by manually threading stringing material such as hair through the rings 22. In another arrangement, the stringing material may be placed in a loop of thread connected to a needle and then the needle and attached thread threaded through the rings 22.

Of course, more than one ornament 20 may be placed on stringing material. For example, when the stringing material comprises hair of a wearer, the wearer may place multiple ornaments 20 on the same or different strands thereof. In the method described above, if the tool 120 is sufficiently long in relation to the ornaments 20, it may be possible to place more than one ornament 20 onto the hair at the same time.

In this arrangement, the two or more ornaments 20 are placed onto the tool 120, the stringing material 142 is extended between the legs 124,126 of the tool 120, and then the two or more ornaments 20 are moved off of the tool 120 on the hair or other stringing material.

Figure 8:
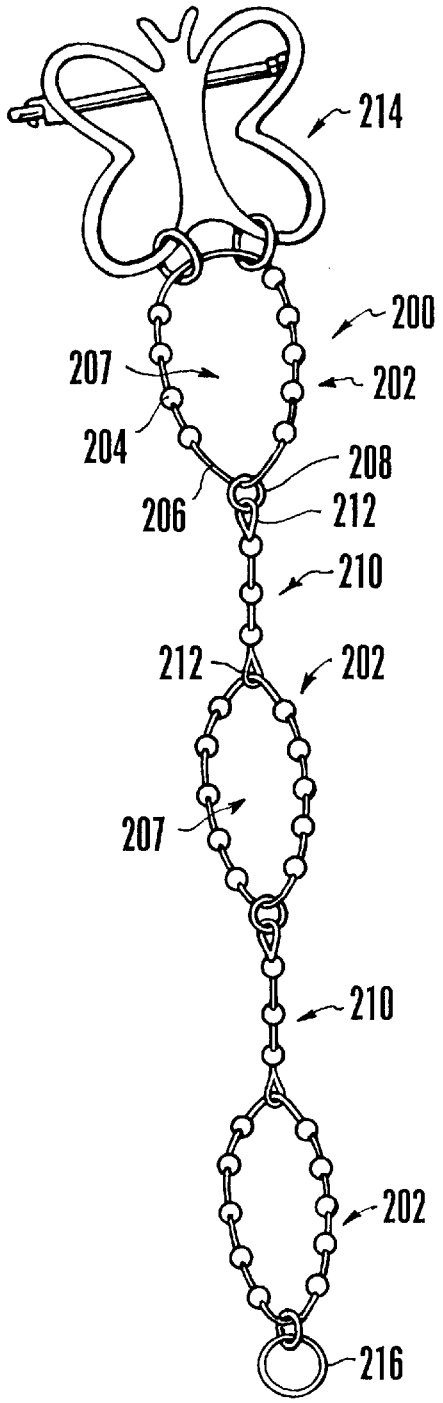
FIG. 8 is a perspective view of an ornament in accordance with a second embodiment of the present invention.

FIG. 8 illustrates another embodiment hair ornament 200 in accordance with the present invention. This embodiment hair ornament 200 includes a retention element and one or more loop elements 202. In the embodiment illustrated, each loop element 202 is formed from a number of interconnected beads 204.

The beads 204 are preferably movably connected, such as by positioning them all on a generally flexible filament, such as a thin wire 206. The beads 204 could also be connected in pairs by individual pins or similar connecting means.

In accordance with one embodiment, the beads 204 are small, hollow metallic balls. Of course, the beads 204 may be constructed from a wide variety of materials such as plastic, ceramic, glass, wood or the like. In addition, the beads 204 may be colored or coated with a paint or other material to alter their appearance. The size of the beads 204 may vary.

In the embodiment illustrated, the number of beads 204 per loop element 202 numbers eight to twelve. The exact number of the beads 204 per loop element 202 may vary however, being greater or lesser than this number. It is preferred, however, that the beads 204, while movably connected and thus permitting the shape of the loop 202 to change, define a loop element 202 having a substantially fixed circumference. In the embodiment illustrated, the circumference of each loop element 202 is approximately 2–3 inches.

An aperture 207 is defined by each loop element 202. When the loop 202 has a circumference of about 2–3 inches, the aperture 207 has a diameter of about 0.5–1 inches.

The beads 204 are separated from one another in relatively fixed positions on the wire 206. This provides a preferred visual appearance for the loop elements 402.

Preferably, the ornament 200 comprises at least two of the loop elements 202 interconnected and arranged sequentially. As illustrated, pairs of loop elements 202 are connected by a link 210. In one embodiment, the link 210 comprises a number of beads 204 connected to one another, such as by positioning them on a short filament such as a wire, as described above.

Preferably, each loop element 202 is movably mounted to its corresponding link 210. In accordance with one embodiment, a ring 208 is connected to at least one loop element 202, such as by positioning the ring 208 on the wire 206 between two beads 204. An eyelet 212 is formed on each end of the link 210. The eyelet 212 may comprise a portion of wire forming the link 210. The ring 208 passes through one eyelet 212 of the link 210, connecting one loop element 202 to the link 210. As illustrated, the link 210 may be directly connected to another loop element 202 by the wire 206 of the loop element 202 passing directly through the eyelet 212.

Of course, the loop elements 202 of the ornament 200 may be connected in a variety of manners. For example, there need not be any link 210 between the loop elements 202, but instead the loop elements may be directly connected to one another.

In one or more embodiments, the ornament 200 includes a means for securing the ornament 200 to hair. In the embodiment illustrated, this means comprises a retention element in the form of a hair lock 214. This lock 214 is similar to the lock 30 described above and illustrated in FIG. 1. As disclosed above, however, the securing means may comprise a wide range of other elements.

Preferably, the lock 214 is positioned at one end of the ornament 200. As illustrated, the lock 214 is connected to an end-most loop element 202. While the ornament 200 comprise but a single loop element 202 connected to the lock 214, in the preferred arrangement a sequence of the loop elements 202 are connected to the lock 214. The loop element 202 which is connected to the lock 214 is preferably moveably connected thereto, such as with small rings, but may be rigidly connected as well.

As also illustrated in FIG. 8, a ring 216 may be connected to the loop element 202 which is positioned opposite the lock 214. This ring 216 is preferably large enough to permit attachment of other ornaments, such as charms and the like.

In accordance with one or more embodiments of the invention, there is provided a method of placing the ornament 200 on ornament stringing material such as one or more strands of hair. The ornament 200 may be placed on hair with a tool 120 such as described above and illustrated in Figure 2 in similar fashion to the ornament 20 as illustrated in FIGS. 3–7. In accordance with this method, the tip 128 of the tool 120 is extended through the aperture 207 defined by one or more of the loop elements 202.

Figure 9:
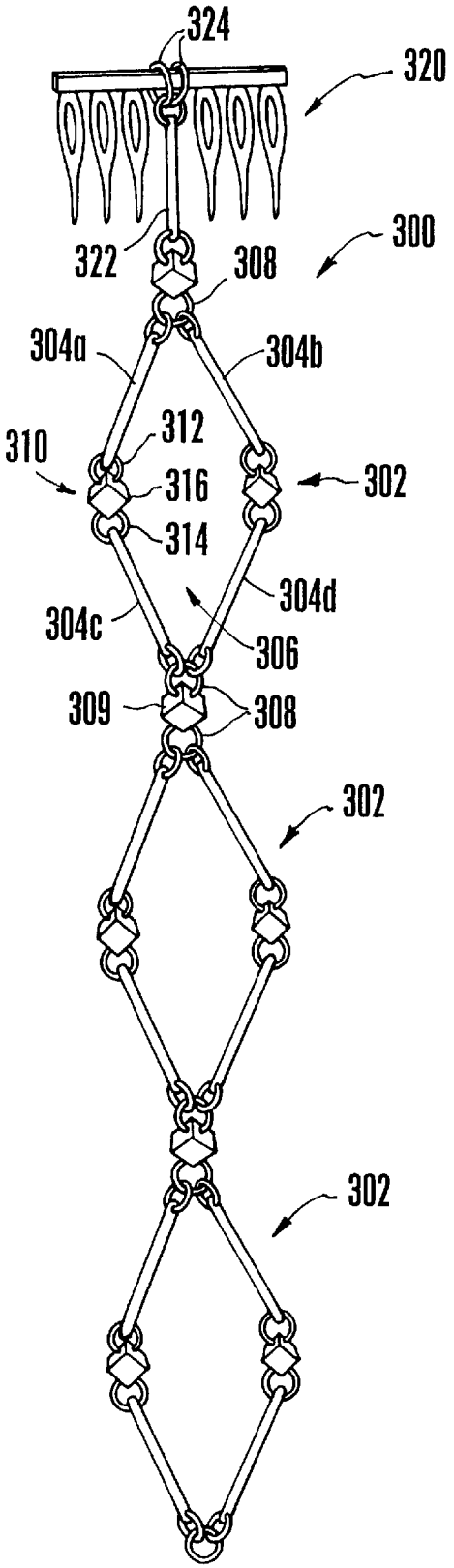
FIG. 9 is a perspective view of an ornament in accordance with a third embodiment of the present invention.

FIG. 9 illustrates another embodiment hair ornament 300 in accordance with the present invention. This hair ornament 300 also includes a retention element and at least one loop element 302. Each loop element 302 of this hair ornament is defined by one or more interconnected rods 304.

In the preferred arrangement, each loop 302 comprises four connected rods or links 304*a*,304*b*,304*c*,304*d* arranged generally in a "diamond" shape. So arranged, the rods 304 define an aperture 306 through which ornament stringing materials such as one or more strands of hair may pass.

As illustrated, pairs of the rods 304 extend towards each other from opposing first mount elements 308. The pairs of rods 304 are connected intermediate of the opposing first mount elements 308 at second mount elements 310. A first rod 304*a* extends from one first mount element 308 to a connection at a second mount element 310 with a third rod 304*c*. A second rod 304*b* extends from one first mount element 308 to a connection at the other second mount element 310 with a fourth rod 304*d*.

Preferably, the rods 304 are movably connected to the mount elements 308,310. In one or more embodiments, the mount elements 308,310 comprise rings or other closed-loop elements. Each rod 304 has a pair of apertures or eyelets at its opposing ends. The first mount element 308 passes through an eyelet at one end of the rod 304, while the second mount element 310 passes through the eyelet at the opposing end of the rod 304.

In the arrangement illustrated, each second mount element 310 comprises a pair of rings 312,314 and a decorative element 316. The decorative element 316 is positioned between the rings 312,314. The decorative element 316 may comprise, for example, a small cubic element.

In one or more embodiments, the ornament 300 includes at least two loop elements 302 connected to one another. In the arrangement illustrated, a first mount element 308 associated with one loop element 302 is connected to a first mount element 308 associated with another loop element 302. In the arrangement where the first mount elements 308 comprise rings, the rings associated with the adjacent loop elements 302 are interconnected. In the embodiment illustrated, the rings comprising the first mount elements 308 are connected by a decorative element 309, such as a cubic element.

Preferably, the multiple loop elements 302 of the ornament 300 are arranged sequentially along an axis or line.

In one or more embodiments, the hair ornament 300 includes means for securing the ornament 300 to hair. As illustrated, the means for securing comprises a retention element in the form of a hair comb 320. In one or more embodiments, the comb 320 is positioned at an end of the ornament 300. In one embodiment, the comb 320 is connected to a first of the loop elements 302. As illustrated, the connection is with a link 322 connected at one end to the comb 320 with one or more rings 324 and at the other end to a connector 316 positioned an end of the first loop element 302. Of course, the comb 320 may be attached to the loop elements 302 of the ornament 300.

In accordance with one or more embodiments of the invention, there is provided a method of placing the ornament 300 on ornament stringing material such as one or more strands of hair. The ornament 300 may be placed on the stringing material with a tool 120 such as described above and illustrated in FIG. 2, in similar fashion to the ornament 20 illustrated in FIGS. 3–7. In accordance with this method, the tool 120 is threaded through the aperture 306 defined by one or more of the loop elements 302. The ornament 300 is then retained on the ornament stringing material by affixing the comb 320 to the stringing material in a manner well known to those of skill in the art.

FIG. 10 illustrates yet another embodiment hair ornament 400 in accordance with the present invention. This hair ornament 400 also includes a retention element and at least one loop element 402.

In accordance with this embodiment of the invention, the loop elements 402 are defined by a strand-like material such as one or more ribbons 404. In the preferred embodiment, the ornament 400 comprises at least two loop elements 402 which are formed by opposing portions of a single ribbon 404.

Each loop element 402 has a top portion 406 where opposing portions of the ribbon 404 meet or are generally close to one another, a bottom portion 408 where the opposing portions of the ribbon 404 meet or are generally close to one another, and a central section 410 where the opposing portions of the ribbon 404 may be some distance apart.

In accordance with one embodiment, a first bead 412 is located at the top portion 406 of the loop element 402. The first bead 412 has a central passage through which the opposing portions of the ribbon 404 extend. The first bead 412 is affixed to at least a portion of the ribbon 404 at this location to prevent the bead 412 from moving along the ribbon. Likewise, a second bead 414 is located at the bottom portion 408 of the loop element 402. The second bead 414 has a central passage through which the opposing portions of the ribbon 404 extend. The second bead 414 is affixed to at least a portion of the ribbon 404 at this location to prevent the bead 414 from moving along the ribbon.

The opposing portions of the ribbon 404 between the first and second beads 412,414 define an aperture 416 through which one or more strands of hair may pass. Preferably, the circumference of this aperture 416 is at least 0.5 inches. As in the previously described embodiments, while the perimeter shape of the loop element 402 may change, the circumferential length does not, even though the ribbon is flexible. In this regard, it is preferred that the ribbon 404 not be significantly extensible or resilient to prevent the circumferential length from changing.

In the embodiment illustrated, a decorative element 418 is provided along each opposing portion of the ribbon 404 between the first and second beads 412,414. This element 418 may comprise a bead or other element connected to the ribbon 404. In one or more embodiments, the element 418 comprises a bead which is similar in appearance to the first and/or second bead 412,414.

While the loop elements 402 are preferably formed by opposing portions of a ribbon 404, those of skill in the art will appreciate that a wide variety of other materials and arrangements may be used. For example, instead of ribbon, string, yarn, cord, rope, or other elongate filament-like material may be used. In addition, the opposing portions forming each loop element 402 may comprise entirely separate elements as opposed to opposing portions of the same element. In addition, the opposing portions forming each loop element 402 may be different elements for each loop element 402 as opposed to the above-described arrangement where opposing portions of the same ribbon 404 form the opposing portions of the two or more loop elements 402.

In one or more embodiments, the ornament 400 includes means for securing the ornament 400 to stringing material such as hair. As illustrated, the means is a retention element in the form of a barrette-type hair lock 420, similar to the lock 30 described above and illustrated in FIG. 1. Of course, the means for securing may comprise other than the lock 420, such as a comb 320 illustrated in FIG. 9 and described above.

In the embodiment illustrated, the lock 420 is connected to the remainder of the ornament 400 by threading the portion of the ribbon 404 defining a top-most loop element 402 through a pair of eyelets 422 attached to the lock 420. Of course, the lock 420 may be connected to the remainder of the ornament 400 in a wide variety of manners, as will be appreciated by those of skill in the art.

As illustrated, one or more decorative elements 424, such as beads, may be positioned on free ends of the ribbon 404 which extends beyond the bottom bead 414 of the last loop element 402 (i.e. that loop element 402 which is opposite the lock 420).

In accordance with one or more embodiments of the invention, there is provided a method of placing the ornament 400 on stringing material such as one or more strands of hair. The ornament 400 may be placed on stringing material with a tool 120 such as that described above and illustrated in FIG. 2 in similar fashion to the ornament 20 illustrated in FIGS. 3–7. In accordance with this method, the tool 120 is threaded through the aperture 416 defined by one or more of the loop elements 402.

FIG. 11 illustrates yet another embodiment hair ornament 500 in accordance with the present invention. This hair ornament 500 also includes a retention element and at least one loop element 502.

In accordance with this embodiment of the invention, each loop element 502 has a top end 506 and a bottom end 508. The loop element 502 defines an aperture or passage 504 therethrough. In the arrangement illustrated, the loop element 502 is generally tubular, with a body portion of the loop element 502 which defines the aperture 504 being generally circular in shape when taken in cross-section along a plane extending perpendicular to an axis extending through the top and bottom 506,508 thereof. The loop element 502 may have a variety of other cross-sectional shapes, however, such as triangular or square.

Preferably, each loop element 502 has a generally fixed circumference (the circumference being the distance traversed by the body of the loop element 502in a direction perpendicular to the axis which extends through the top and bottom ends 506,508). As such, the diameter or other dimension of the aperture 504 (i.e. in a direction generally perpendicular to the axis extending through the top and bottom ends 506,508 of the loop element 502) generally does not change. In one or more embodiments, the loop element 502 is constructed from a relatively rigid material such as metal, plastic, wood or the like.

The loop element 502 as described above has a length from its top end 506 to its bottom end 508 which is generally constant. It is possible for the loop element to be constructed so this distance may vary. For example, the loop element 502 may have the form similar to a helical spring.

As illustrated, the ornament 500 comprises multiple loop elements 502 moveably connected to one another. In the arrangement illustrated, the loop elements 502 are connected by one or more chains 510. Of course, the loop elements 502 may be connected by a wide variety of other means, such as filament like material (thread, wire, ribbon, etc.), a hinge connection or the like. Preferably, the loop elements 502 are arranged so that the axes which extend through the apertures 504 of the loop elements 502 are generally aligned.

In one or more embodiments, the ornament 500 includes means for securing the ornament 500 to stringing material such as hair. As illustrated, the means is a retention element in the form of a barrette-type hair lock 520, similar to the lock 30 described above and illustrated in FIG. 1. Of course, the means for securing may comprise other than the lock 520, such as a comb 320 illustrated in FIG. 9 and described above.

In the embodiment illustrated, the lock 520 is moveably connected to the remainder of the ornament 500. Preferably, the lock 520 is connected to a top-most of the loop elements 502 by a pair of chains 512. Of course, the lock 520 may be connected to the remainder of the ornament 500 in a wide variety of manners, as will be appreciated by those of skill in the art, such as a with one or more individual rings, filament-like material, or directly by passing one or more portions of the lock 520 through an aperture(s) in a top-most of the loop elements 502.

In accordance with one or more embodiments of the invention, there is provided a method of placing the ornament 500 on stringing material such as one or more strands of hair. The ornament 500 may be placed on stringing material with a tool 120 such as that described above and illustrated in FIG. 2 in similar fashion to the ornament 20 illustrated in FIGS. 3–7. In accordance with this method, the tool 120 is threaded through the aperture 504 defined by one or more of the loop elements 502.

FIG. 12 illustrates yet another embodiment of an ornament 600 in accordance with the invention. This ornament 600 is similar to the ornament 20 illustrated in FIG. 1, and illustrates how the structure of an ornament in accordance with the invention may vary, such as by including one or more decorative elements.

This embodiment ornament 600 includes, like the ornament 20 illustrated in FIG. 1, a retention element 632 and multiple rings 622 which are movably connected. In accordance with this embodiment of the invention, however, a decorative element 630 is positioned in the sequence of at least two rings 622.

Two rings 622 are connected to a means for securing the ornament 600. This means comprises a retention element in the form of a comb 632 similar to that illustrated in FIG. 9 and described above. The decorative element 630 is connected to the second of the two rings 622. Third and fourth rings 622 are then connected to the decorative element 630. The element 630 is connected by interlocking rings 634 to the second and third rings 622.

The decorative element 630 may comprise any number of items. As illustrated, the element 630 comprises a butterfly-shaped metallic charm. Of course, the element 630 may be constructed of a wide variety of materials and have a wide variety of shapes and sizes.

The ornament 600 may include more than one decorative element 630. The element 630 may be positioned on the ornament 600 at other than the location illustrated. For example, the element 630 may be positioned between the retention element 632 and the first ring 622. In addition, the ornament 600 need not comprise the same number of rings 622 illustrated, but may include a greater or lesser number thereof.

The ornament 600 may be placed on ornament stringing material in accordance with a wide variety of methods, including the method illustrated in FIGS. 3–7 using the tool 120 illustrated in FIG. 2 and described above.

The ornament 600 may be placed on ornament stringing material such that the decorative element 630 is readily visible and provides an appealing visual effect. Referring to FIG. 13, the ornament 600 may be placed so that the ornament stringing material, such as hair, passes through the first ring 622, under or behind the second ring, decorative element 630 and third ring, and then through the fourth ring 622. In this fashion, the decorative element 630 is not obscured by the ornament stringing material when the ornament 600 is placed thereon, but instead is clearly visible.

When the ornament 600 is placed onto stringing material as illustrated in FIG. 13 using the tool 120 illustrated in FIG. 3, only the loop elements through which the stringing material are to pass are threaded onto the tool. This is made easy because the loop elements are movably connected, permitting some but not all loop elements to be aligned and placed on the tool 120.

Of course, any of the embodiments of ornaments 20,200, 300,400,500,600 described above may include one or more decorative elements such as described above. In addition, any ornament in accordance with the invention may be placed onto stringing material without the stringing material being passed through each and every loop element thereof.

The one or more loop elements of the ornaments 20,200, 300,400,500,600 described above may vary. In general, each loop element is arranged to contain or receive ornament stringing material such as hair. As those of skill in the art will appreciate, other elements/structures than those describe are capable of this purpose. For example, the loop elements may comprise beads.

The loop elements also do not necessarily need to define a closed perimeter or circumference, so long as they receive and retain ornament stringing material. For example, the rings 22 of the ornament 20 illustrated in FIG. 1 do not need to be closed. The rings 22 might comprise open loops having first and second ends which do not connect, but overlap. In such an arrangement, the ring 22 while not defining a closed perimeter would encircle ornament stringing material in a manner to retain it in position. As another example, the loop elements might comprise spiral-shaped elements having an open central section for receiving and retaining hair. The loop elements may also comprise loops formed within other loops or structures.

In accordance with the invention, the loop elements of the ornaments have a circumference which is generally fixed in length. This arrangement avoids the above-described problem associated with certain prior art ornaments of the user needing to expand one or more resilient elements to place them on hair.

In accordance with the invention, one or more loop elements comprising each ornament are movably connected. This makes it possible for long and large ornaments to be placed onto a tool (such as tool 120) for placing the ornament on hair. In addition, this arrangement permits the ornament to conform to the curved shape of a wearer's head and the flexible nature of a wearer's hair.

In accordance with the invention, an arrangement of the loop elements in a linear sequence permits alignment of the apertures defined thereby. This permits the loop elements to be easily threaded onto a tool for placing the ornament onto ornament stringing material. The ornaments of the invention also serve to guide or retain the ornament stringing material, keeping the ornament stringing material in a desired position.

The linear sequence of loop elements is preferably arranged below a retention element. In this manner, when the retention element is connected to hair or other stringing material, the loop elements naturally "dangle" (naturally under the force of gravity) from the retention element in the same direction as hair or other stringing material.

The arrangement of the loop elements in sequence also provides visually appealing ornament. Also, the linear arrangement conforms with the elongate filament nature of hair (as illustrated in FIG. 2) and its generally natural flow under the force of gravity (as discussed above).

It will be understood that the above described arrangements of apparatus and the method therefrom are merely illustrative of applications of the principles of this invention and many other embodiments and modifications may be made without departing from the spirit and scope of the invention as defined in the claims.

I claim:

1. An ornament for ornamenting a stringing material comprising:

a retention element having a first ornament stringing material engaging portion for affixing said ornament to stringing material and a second portion;

a first loop element connected to said second portion of said retention element, said first loop element having a circumference and an interior portion through which stringing material may pass, said circumference having generally fixed total length; and a second loop element, said second loop element moveably connected to said first loop element with a swivel element, said second loop element having a circumference and an interior portion through which said stringing material may pass, said circumference having a generally fixed total length, said swivel element generally retaining said connected first and second loops in generally parallel planes.

2. The ornament in accordance with claim 1 wherein said first and second loop elements extend generally along a first axis, said first and second loop elements movably connected to one another in a manner permitting movement about at least a second axis extending generally perpendicular to said first axis.

3. The ornament in accordance with claim 1 wherein at least one of said first and second loop elements comprises a ring.

4. The ornament in accordance with claim 1 wherein at least one of said first and second loop elements comprises a filament material.

5. The ornament in accordance with claim 4 wherein one or more beads are positioned along said filament material.

6. The ornament in accordance with claim 4 wherein said filament material comprises ribbon.

7. The ornament in accordance with claim 2 wherein said first and second loop elements are arranged sequentially.

8. The ornament in accordance with claim 1 wherein said ornament includes at least one third loop and further including an ornamental element positioned between and interconnecting at least two of said loop elements.

9. The ornament in accordance with claim 1 wherein said swivel element permits said first and second loops to be moved into an adjacent position where an interior portion of each of said first and second loop elements is alignable along a common axis for threading onto a tool.

10. The ornament in accordance with claim 1 wherein at least one of said first and second loop elements is defined by four interconnected links.

11. The ornament in accordance with claim 1 wherein said swivel element comprises a body having an elongate passage through which said loop elements extend.

12. A method of ornamenting a stringing material with at least one ornament comprising a retention element for retaining the at least one ornament to the stringing material and at least one loop element, each loop element defining an aperture therethrough with a tool having a proximal end and a distal end, comprising the steps of:

passing said proximal end of said tool through said aperture of one or more of the loop elements;

extending stringing material between said one or more of the loop elements and an end of the tool; and moving said one or more of the loop elements off of said tool onto said stringing material.

13. The method in accordance with claim 12 including the step of attaching said retention element to said stringing material.

14. The method in accordance with claim 12 wherein the ornament has two or more loop elements and wherein said step of passing said proximal end of said tool through said aperture of one or more of the loop elements comprises passing said proximal end through fewer than all of said loop elements.

15. The method in accordance with claim 12 including the step of collapsing said loop elements onto one another on said tool.

16. The method in accordance with claim 12 wherein the ornament has two or more loop elements and including the step of moving said loop elements with respect to one another.

17. A method of ornamenting a stringing material with at least one ornament comprising a retention element for retaining the at least one ornament to the stringing material, a plurality of loop elements connected to said retention element, one or more of said loop elements defining an aperture therethrough having a first side and an opposing second side, comprising the steps of passing stringing material through said aperture of a first of said loop elements from said first side and through a second of said loop elements from said second side, and engaging said retention element with said stringing material to retain said ornament on said stringing material, whereby said ornament is retained in said ornament stringing material and said stringing material flows from a first to a second side of said loop elements in alternating fashion.

18. The method in accordance with claim 17 including the step of passing said stringing material through said loops with a tool.

19. The method in accordance with claim 18 including the step of placing said loop elements on said tool such that said loop elements through which said stringing material is to pass have said first and second sides arranged in alternating directions.

20. The method in accordance with claim 17 including the step of extending said stringing material over at least one loop positioned between at least two loops through which said stringing material passes.

* * * * *